US012805686B2

(12) United States Patent
Schnitzer et al.

(10) Patent No.: US 12,805,686 B2
(45) Date of Patent: Nov. 24, 2026

(54) CLEANING ROBOT

(71) Applicant: BSH Hausgeräte GmbH, Munich (DE)

(72) Inventors: Frank Schnitzer, Bad Neustadt (DE); Kristina Daniel, Bad Neustadt (DE); Stefan Hassfurter, Maroldsweisach (DE)

(73) Assignee: BSH Hausgeräte GmbH, Munich (DE)

( * ) Notice: Subject to any disclaimer, the term of this patent is extended or adjusted under 35 U.S.C. 154(b) by 304 days.

(21) Appl. No.: 18/693,235

(22) PCT Filed: Sep. 5, 2022

(86) PCT No.: PCT/EP2022/074566

§ 371 (c)(1),
(2) Date: Mar. 19, 2024

(87) PCT Pub. No.: WO2023/046446

PCT Pub. Date: Mar. 30, 2023

(65) Prior Publication Data

US 2024/0285145 A1 Aug. 29, 2024

(30) Foreign Application Priority Data

Sep. 23, 2021 (DE) ..... 10 2021 210 609.9

(51) Int. Cl.
*A47L 11/40* (2006.01)
*A47L 11/24* (2006.01)

(52) U.S. Cl.
CPC ..... *A47L 11/4038* (2013.01); *A47L 11/24* (2013.01); *A47L 11/4052* (2013.01); *A47L 11/4069* (2013.01)

(58) Field of Classification Search
CPC ..... A47L 11/4038; A47L 11/4052; A47L 11/4069
See application file for complete search history.

(56) References Cited

U.S. PATENT DOCUMENTS

| | | | |
|---|---|---|---|
| 6,938,298 | B2 | 9/2005 | Aasen |
| 9,364,129 | B2 | 6/2016 | Weis et al. |
| 2004/0031113 | A1 | 2/2004 | Wosewick et al. |
| 2017/0290487 | A1 | 10/2017 | Yang et al. |

FOREIGN PATENT DOCUMENTS

| | | | |
|---|---|---|---|
| DE | 60107721 | T2 | 12/2005 |
| DE | 102009049637 | A1 | 4/2011 |
| DE | 102010045096 | A1 | 3/2012 |
| WO | 2016123421 | A1 | 8/2016 |

OTHER PUBLICATIONS

Grabham, Vileda Virobi auto mops your floors , Aug. 13, 2012, Stuff TV, https://www.stuff.tv/news/vileda-virobi-auto-mops-your-floors/.

*Primary Examiner* — Shay Karls
(74) *Attorney, Agent, or Firm* — Laurence A. Greenberg; Werner H. Stemer; Ralph E. Locher

(57) ABSTRACT

A cleaning robot with a housing and a flat cleaning element to be moved along a floor surface. A portion of the cleaning element projects from a periphery of the housing, and the cleaning element is flexible such that it can be vertically deformed when colliding with an obstacle. A pressing device for pressing a portion of the cleaning element located under the housing against the floor surface.

10 Claims, 6 Drawing Sheets

CLEANING ROBOT

FIELD AND BACKGROUND OF THE INVENTION

The invention relates to a cleaning robot. In particular, the invention relates to a cleaning robot having a cleaning element for cleaning a floor surface.

A conventional cleaning robot is configured so as to move autonomously over a floor surface in a household and in so doing to clean the floor surface. In one configuration as a robotic vacuum cleaner, a suction unit is provided in order to clean the floor surface pneumatically. Optionally, a rotating brush or a bristle roller can also be provided for cleaning the floor surface. A different type of cleaning robot uses a movable cleaning element, by way of example a cushion or a disk which is moved relative to the floor surface in order to pick up dirt. Cleaning often takes place using a cleaning fluid.

The larger the cleaning element in relation to the cleaning robot, the more efficiently the floor surface can be cleaned since fewer movements of the cleaning robot are required in order to cover a predetermined floor surface. Moreover, in the case of a large cleaning element, the fluid can have greater opportunity to act on the floor surface. However, a large cleaning element usually protrudes over a contour of the cleaning robot and can easily collide with an obstacle, by way of example a piece of furniture or a wall. A control apparatus for controlling the cleaning robot must therefore be adapted to the protruding cleaning element. In particular in the case of a cleaning robot whose cleaning element that is guided over the floor surface is only optionally attached, the adaptation can be complex. If the cleaning element is attached to the cleaning robot, maneuverability or the ability to clean small corners or angles can be limited.

SUMMARY OF THE INVENTION

An underlying object of the present invention is to provide an improved cleaning robot having a cleaning element that is guided over a floor surface. The invention achieves this object by means of the subject of the independent claim. Subordinate claims disclose preferred embodiments.

According to the present invention, a cleaning robot comprises a housing, a flat cleaning element and a contact pressure facility. The cleaning element is configured so as to be moved along a floor surface; wherein a portion of the cleaning element protrudes beyond a contour of the housing and the cleaning element is flexible in order to be deformed vertically in the event of a collision with an obstacle. The contact pressure facility is designed to press a section of the cleaning element that is located below the housing against the floor surface.

The cleaning robot according to the invention can use a relatively large cleaning element so that its track width can be large with regard to the cleaning. A predetermined floor surface can therefore be completely cleaned with relatively few movements of the cleaning robot. In addition, the large cleaning element can achieve improved cleaning of the floor surface. Since the cleaning element is flexible, a section that protrudes beyond the contours of the housing in particular can be deformed vertically in the event of a collision with an obstacle and folded out of the way. Neither the cleaning element nor the obstacle can be damaged. A control apparatus for controlling the cleaning robot does not need to be adapted to the section of the cleaning element that protrudes beyond the contour of the housing.

The control of the cleaning robot can be unchanged if it is used with or without the cleaning element. The cleaning robot can also clean the floor surface better in small corners or angles. The contact pressure facility can maintain vertical pressure on the cleaning element so that the cleaning of the floor surface is effective.

The cleaning robot preferably comprises a drive for moving the cleaning element relative to the housing. The drive can be configured so as to drive the cleaning element in a cyclical, oscillating or linear movement, for example. This allows the cleaning element to move faster over the floor surface than the cleaning robot. The cleaning effect can be intensified.

In a simple embodiment, the contact pressure facility comprises a contact pressure plate.

The contact pressure plate is located above the cleaning element and is supported relative to the housing of the cleaning robot. The contact pressure plate can be rigid or flexible. It can cover the entire section of the cleaning element that is located below the housing or only part of the section. A surface of the contact pressure plate can form a low coefficient of friction with the cleaning element.

In order to further reduce frictional forces between the contact pressure facility and the cleaning element, the contact pressure facility can comprise one or more contact pressure elements, each of which is rotatable about an essentially horizontal axis of rotation. A contact pressure element can be flexible and made of a polyurethane foam, for example. Alternatively, the contact pressure element can also be elastic and can be made from a rubber or a polymer, for example. In yet a further embodiment, the contact pressure element is rigid. The energy absorption of the drive can be reduced due to the reduced friction.

In a particularly preferred embodiment, the cleaning element is configured so as to be rotated about an essentially vertical axis of rotation relative to the housing. The horizontal axis of rotation of a contact pressure element is essentially perpendicular to the vertical axis of rotation of the cleaning element. The cleaning element preferably has the shape of a circular surface or sweeps over a circular surface when it is rotated about the vertical axis of rotation. In various embodiments, one or more horizontal axes of rotation can be provided, on each of which one or more contact pressure elements can be provided. Adjacent contact pressure elements on a horizontal axis of rotation can take into account the different circumferential speeds of the cleaning element rotating about the vertical axis of rotation. A possible width of a contact pressure element can be in the range of approx. 0.5 to 2 cm. In another embodiment, a contact pressure element can also be wider and, in extreme cases, extend over the entire radius of the cleaning element. In this case, the contact pressure element can be cylindrical.

In a further embodiment, the contact pressure element has the shape of a truncated cone. A first end of the truncated cone faces the vertical axis of rotation of the cleaning element and a second end faces away from it. A circumference of the contact pressure element can be smaller at the first end than at the second end. The circumferences are preferably selected so that the contact pressure element can engage with the cleaning element, which rotates about the vertical axis of rotation, at both ends without slipping. The contact pressure element does not have to cover the full radius of the cleaning element. If a plurality of contact pressure elements is provided on different horizontal axes of rotation, these can cover different radius sections of the cleaning element. The axis of rotation of the contact pressure element is usually not exactly horizontal, but forms a small angle with the substrate due to its conicity. The angle between the axis of rotation of the contact pressure element and the axis of rotation of the cleaning element can therefore deviate slightly from a right angle.

The drive and a contact pressure element can be coupled to each other in their movements. In a first embodiment, the drive acts on the cleaning element via a contact pressure element. In this way, a force for moving the cleaning element can be applied to the cleaning element over a relatively large area. In a second embodiment, the drive acts on the cleaning element, whereby the cleaning element drives the contact pressure element. In both embodiments, it is possible to improve the prevention of the flexible cleaning element being deformed or lifted from the floor surface under the influence of a driving force. Engagement between the contact pressure element and the cleaning element can be in a non-positive locking or positive-locking manner.

The contact pressure element can be structured on a surface facing the cleaning element. The surface can, for example, be roughened or have regular or irregular bodies extending in the direction of the cleaning element. This can improve engagement between the contact pressure element and the cleaning element.

Depending on the shape, size and distribution of the engagement bodies, a contact pressure force of the contact pressure element on the cleaning element can also be modulated.

In yet a further embodiment, the cleaning element is structured on a surface associated with the contact pressure element. A similar effect can be achieved as in the latter embodiment. The embodiments can also be combined with each other so that the cleaning element and the contact pressure element have corresponding structured surfaces. These can engage positively with one another in order to transmit an improved force between them.

The invention will now be described in more detail with reference to the accompanying figures, in which:

DETAILED DESCRIPTION OF THE INVENTION

Figure 1:
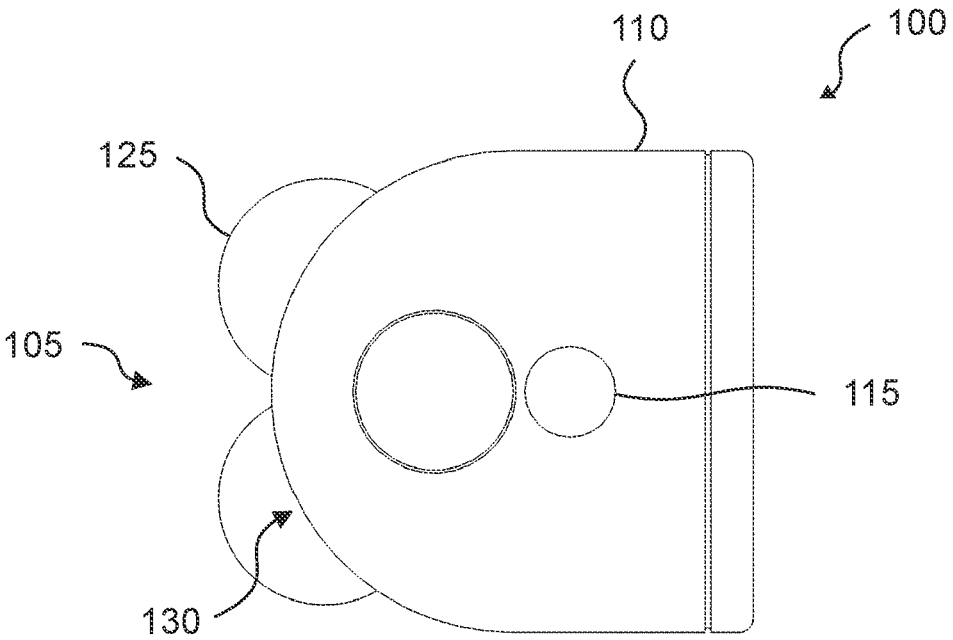
FIGS. 1 and 2 show a cleaning robot having movable cleaning elements.
Figure 2:
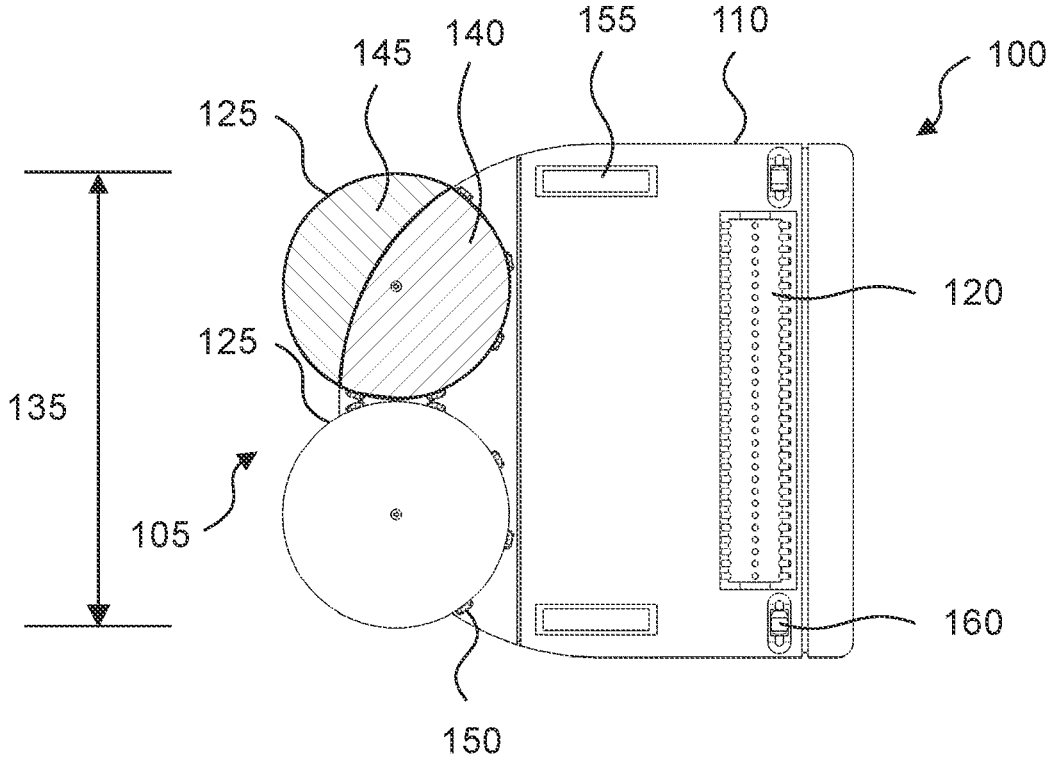

FIGS. 1 and 2 show a cleaning robot 100 from different sides. FIG. 1 shows the cleaning robot 100 from above and FIG. 2 from below. The cleaning robot 100 is configured so as to move over the floor surface 105 and to clean it.

A contour of the cleaning robot 100 is defined by a housing 110. A sensor 115 for non-contact scanning of an environment for example a LIDAR sensor can be provided on an upper side of the housing 110. A conventional cleaning facility 120, which can comprise a suction unit and/or a brush roller, is optionally provided on an underside of the housing 110. In addition, a cleaning element 125 is provided, which can be moved relative to the housing 110 by means of a drive 130. A plurality of cleaning elements 125 can also be provided. In FIG. 1, two cleaning elements 125 are provided by way of example, which are attached to the housing 110 in such a way that they touch each other or slightly overlap. This results in a processing width 135 of the cleaning robot 100 on the floor surface 105, as indicated in FIG. 2. The processing width 135 can also exceed a width of the housing 110.

The cleaning element 125 lies on a first section 140 below the housing 110 and protrudes beyond the housing 110 on a second section 145. The sections 140, 145 are identified by different hatching in FIG. 2. The cleaning element 125 is preferably flat, for example disc-shaped, further preferably flexible, and can be made of silicone, polymer or textile, for example. A contact pressure apparatus 150 is provided in the region of the first section 140 in order to press the cleaning element 125 against the floor surface 105. The contact pressure apparatus 150 can act on the entire first section 140 or only on a part thereof.

A drive wheel 155 can be provided to move the cleaning robot 100 over the floor surface 105. In addition, one or more support wheels 160 can optionally be provided. The drive wheel 155 can be controlled by means of a control apparatus (not shown), which is set up to systematically guide the cleaning robot 100 over the floor surface depending on a scan by means of the sensor 115. At the same time, the control apparatus can control the cleaning facility 120 and/or a movement of the cleaning element 125. In addition, the control apparatus can control a moistening facility of a cleaning element 125 or of a section that is located in front of the cleaning robot 100.

Figure 3:
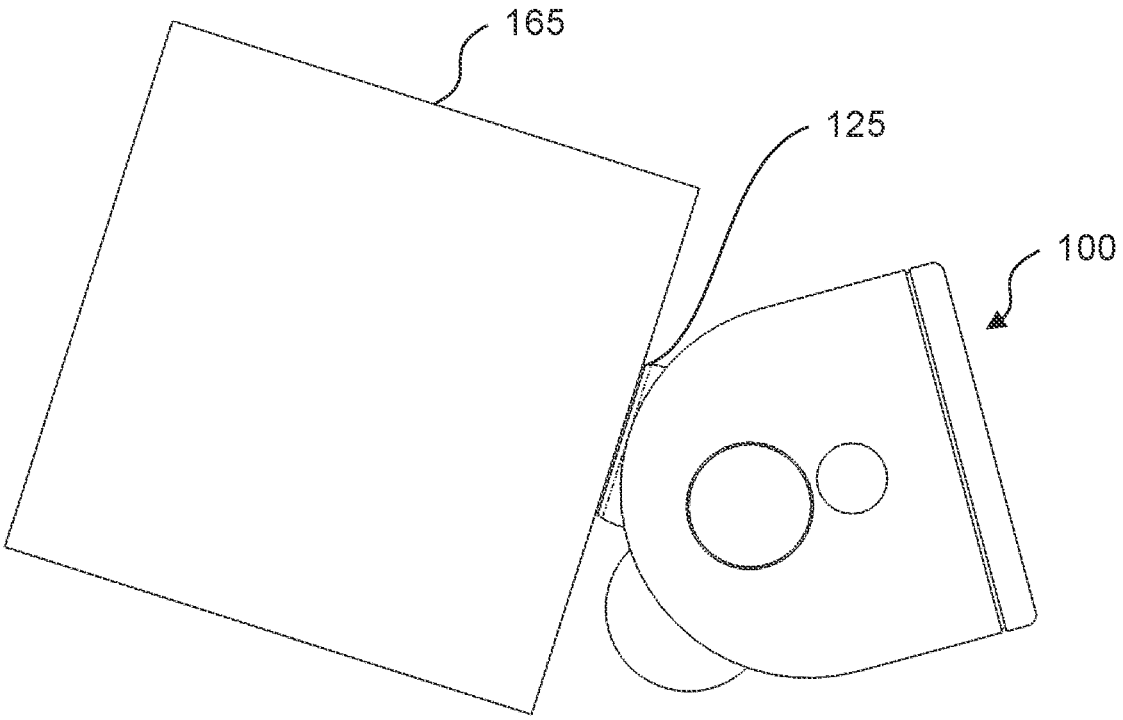
FIGS. 3 and 4 show a cleaning robot in collision with an obstacle.
Figure 4:
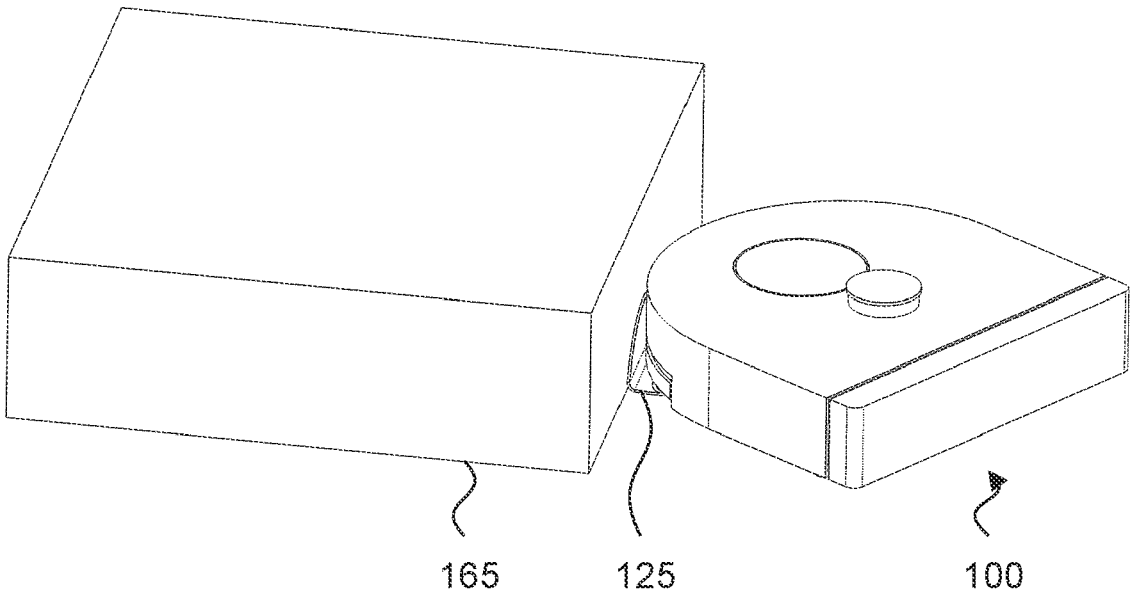

FIGS. 3 and 4 show a cleaning robot 100 in a collision with an obstacle 165. The obstacle 165 can comprise, for example, a piece of furniture, another object in a household, a person or a wall. The first section 140 of the cleaning element 125 that is located below the housing 110 is protected from making contact with the obstacle 165. In the second section 145, the flexible cleaning element 125 can be deflected upwards and deformed to such an extent that it deflects upwards and places itself in a horizontal direction between the cleaning robot 100 and the obstacle 165. Since the cleaning element 125 is made of a flat, preferably thin material, the cleaning robot 100 can practically travel right up to the obstacle 165 despite the cleaning element 125 protruding beyond its contour. Damage to the obstacle 165 is preferably ruled out by the flexible or soft material of the cleaning element 125.

Figure 5:
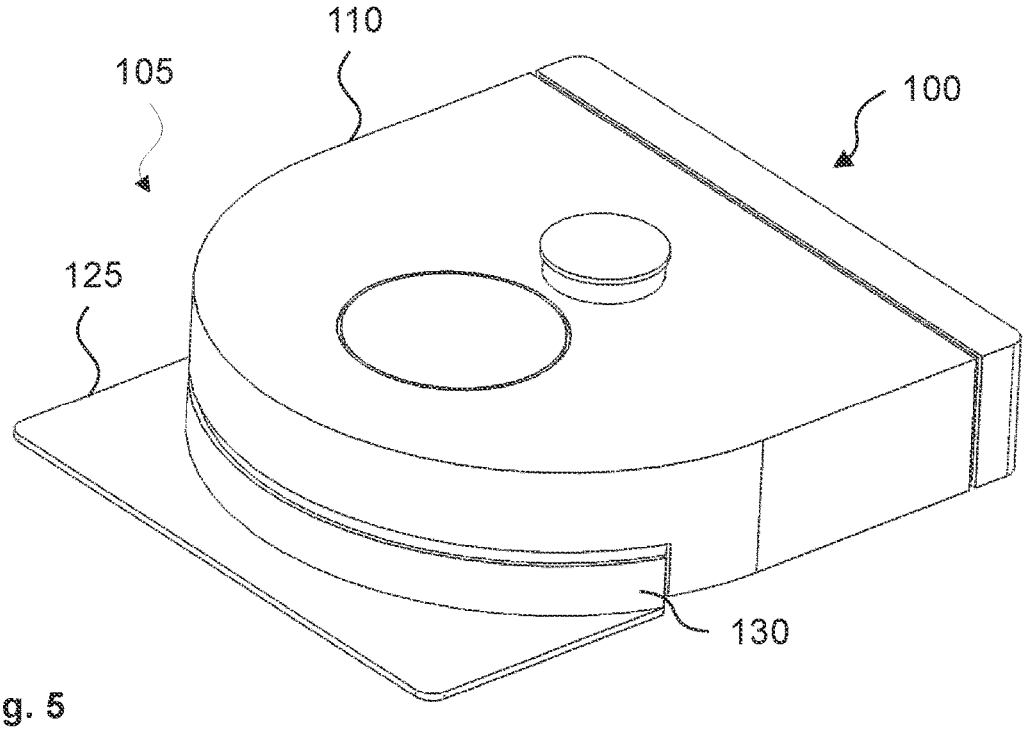
FIGS. 5 to 11 show further embodiments of a cleaning robot.

FIG. 5 shows a further embodiment of a cleaning robot 100. Here, the cleaning element 125 is not rotatable about a vertical axis, but is arranged to be displaceable relative to the housing 110 parallel to the floor surface 105. The drive 130 can, for example, be set up to move the cleaning element 125 in an oscillating manner in a longitudinal or transverse direction. Alternatively, the cleaning element 125 can also be guided on an ellipse or a circle, for example. As an example, the cleaning element 125 is essentially rectangular, but other shapes are also conceivable.

Figure 6:
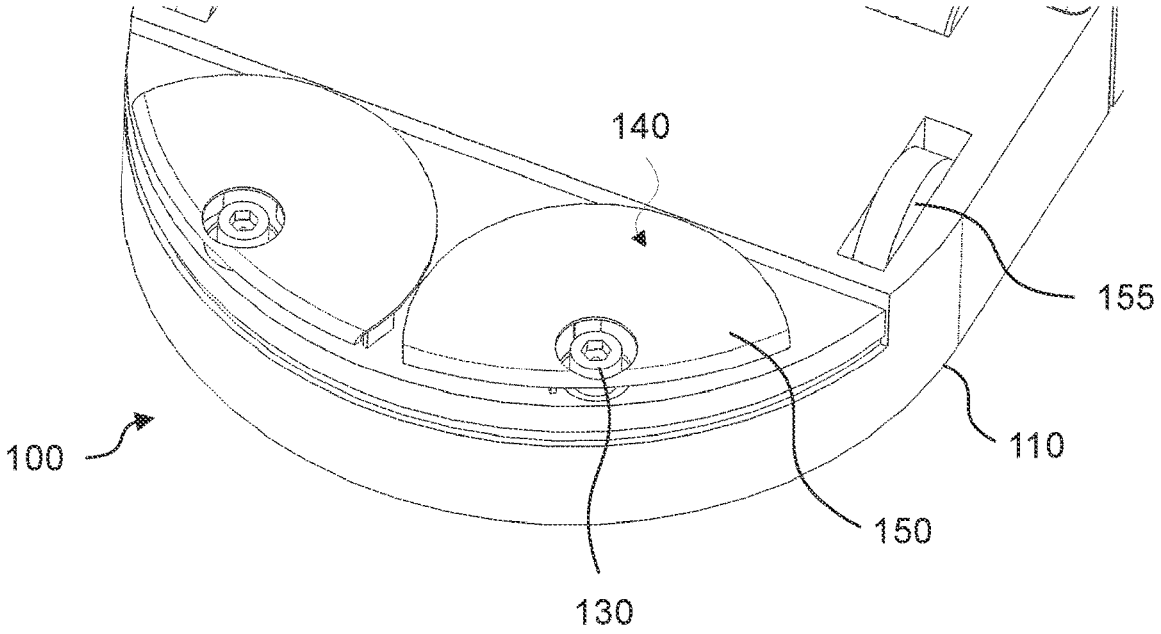

FIG. 6 shows a further embodiment of a cleaning robot 100 from its underside. A cleaning element 125 is removed so that the drive 130 is visible, which is configured so as to rotate the cleaning element 125 about an in particular vertical axis of rotation. Also visible is a contact pressure apparatus 150 that is designed as a contact pressure plate. If the cleaning element 125 is connected to the drive 130, it can be pressed against the floor surface 105 in the first section 140 by the contact pressure plate 150. A surface of the contact pressure plate 150 is preferably smooth in order to minimize frictional forces to the cleaning element 125.

Figure 7:
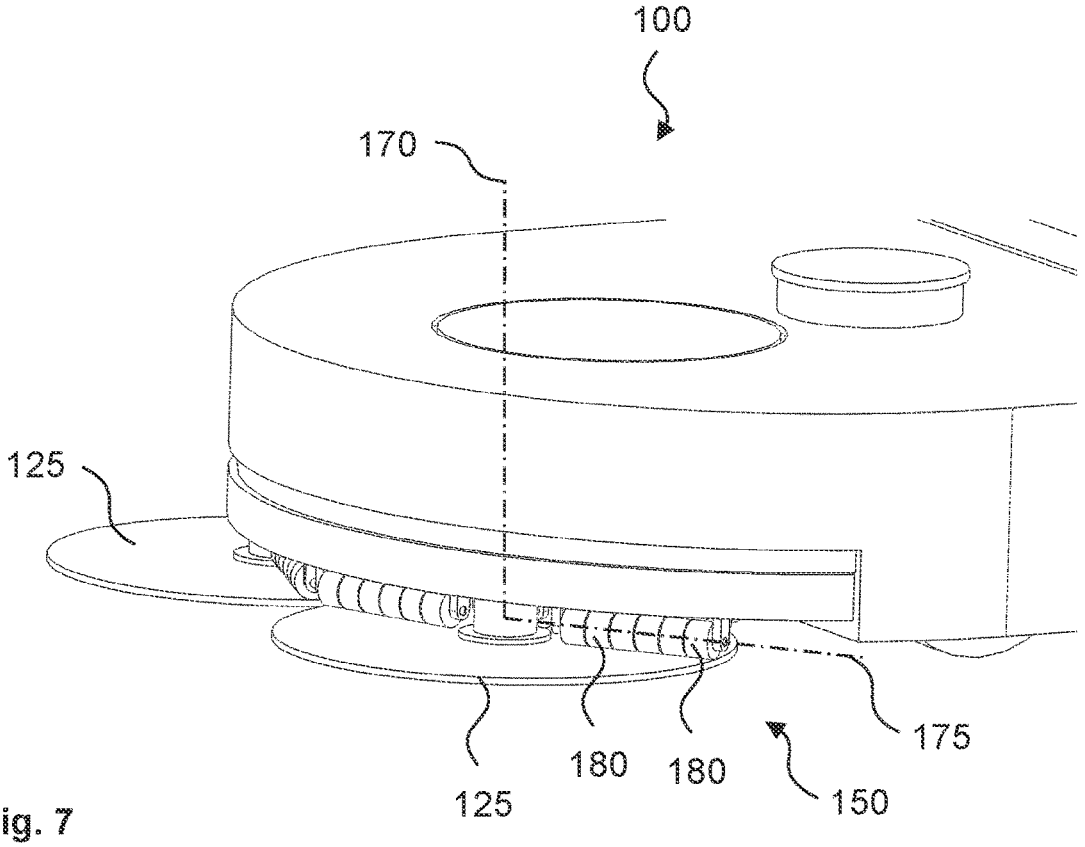

FIG. 7 shows yet a further embodiment of a cleaning robot 100. The cleaning element 125 is rotatably mounted about a vertical axis of rotation 170. A horizontal axis of rotation 175, about which the contact pressure apparatus 150 can be rotated, runs perpendicular to this. The contact pressure apparatus 150 comprises a plurality of contact pressure elements 180 which is arranged axially offset on the horizontal axis of rotation 175. In the illustrated embodiment, all of the contact pressure elements 180, which are located on the same axis of rotation 175, have the same radius. The individual contact pressure elements 180 are not connected to each other in a rotationally fixed manner, so that a contact pressure element 180 that is lying radially inwards relative to the vertical axis of rotation 170 can rotate more slowly than a contact pressure element 180 that is lying radially further outwards when the cleaning element 125 is rotated about the vertical axis of rotation 170. In another embodiment, only one contact pressure element 180 can be provided, which can extend over a predetermined section of the radius of the cleaning element 125.

Figure 8:
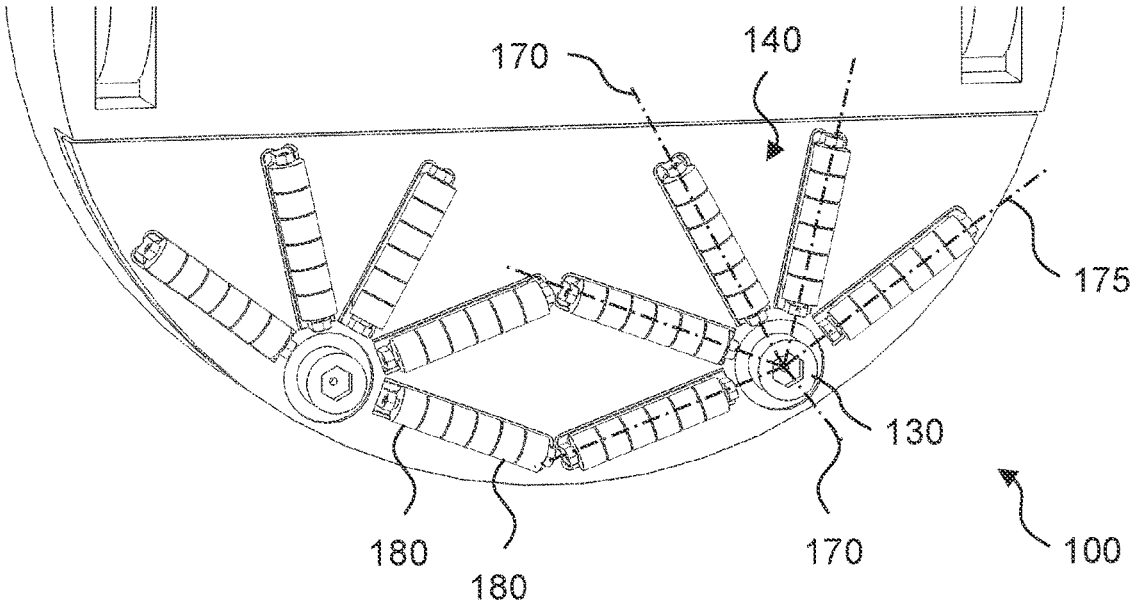

FIG. 8 shows the embodiment of a cleaning robot 100 according to FIG. 7 in a view from below and with the cleaning element 125 removed. It can be seen here that preferably a plurality of horizontal axes of rotation 175 is provided, on each of which one or more contact pressure elements 180 are arranged. Preferably, all horizontal axes of rotation 175 lie in one plane, which usually runs parallel to the floor surface 105, and are perpendicular to the vertical axis of rotation 170.

Figure 9:
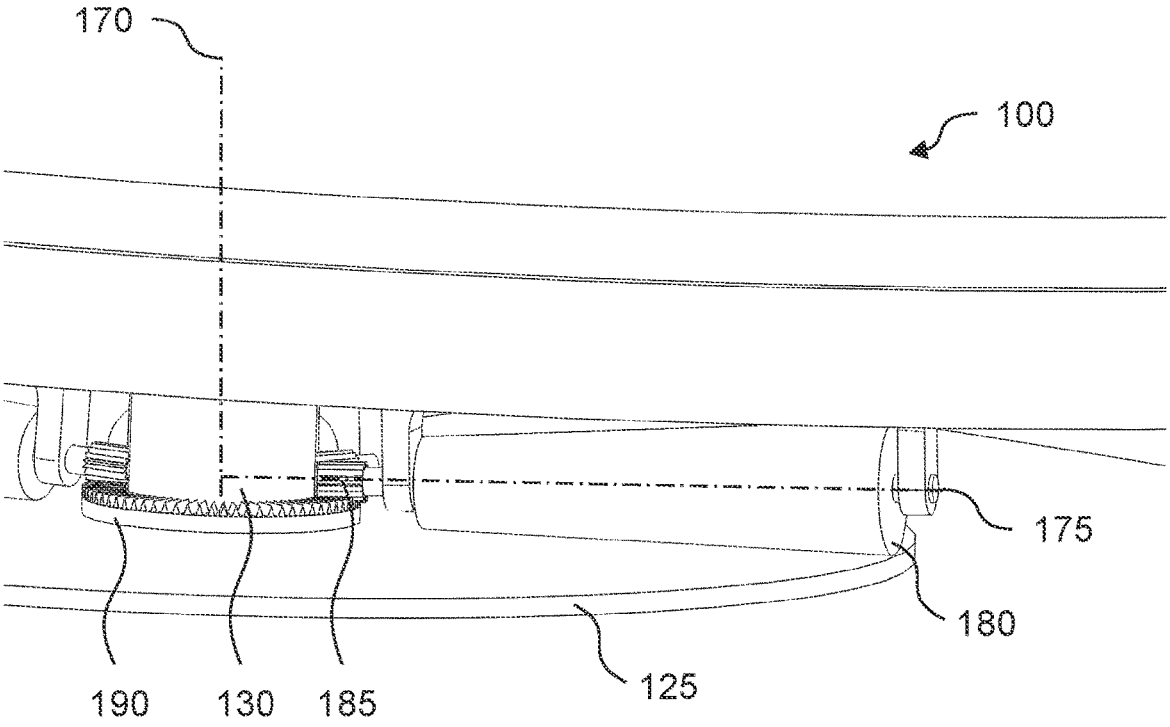

FIG. 9 shows yet a further embodiment of a cleaning robot 100. Here, a contact pressure element 180 is provided which has the shape of a truncated cone, so that its circumference about the essentially horizontal axis of rotation 175 decreases with decreasing distance from the vertical axis of rotation 170. In addition, the contact pressure element 180 is designed to be driven. For this purpose, a shaft is connected along the horizontal axis of rotation 175 to a first gearwheel 185, which is in engagement with a second gearwheel 190, which is rotatable about the vertical axis of rotation 170. In one embodiment, the drive 130 is configured so as to drive the second gearwheel 190. The cleaning element 125 can then be driven about the vertical axis of rotation 170 by the contact pressure element 180. In another embodiment, the drive 130 is configured so as to drive the cleaning element 125 about the vertical axis of rotation 170, wherein the second gearwheel 190 is fixedly connected to the cleaning element 125 so that it drives the first gearwheel 185 and thus the contact pressure element 180 about the essentially horizontal axis of rotation 175.

Figure 10:
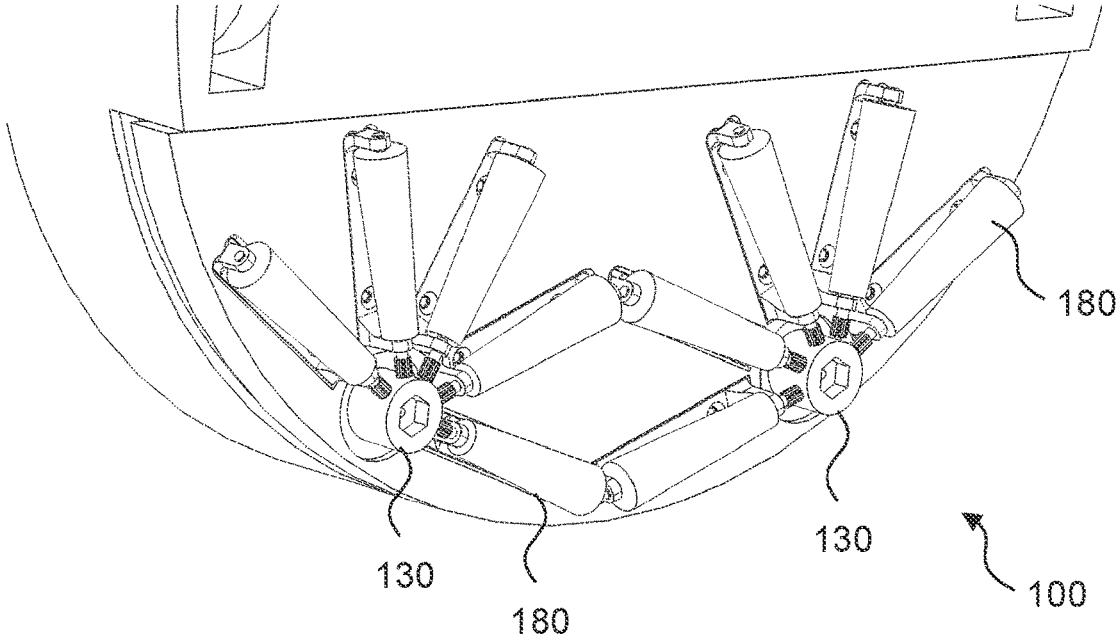

FIG. 10 shows a cleaning robot 100 according to FIG. 9 in a view from the underside and with the cleaning element 125 removed. In this embodiment, the second gearwheel 190 is also removed together with the cleaning element 125.

Figure 11:
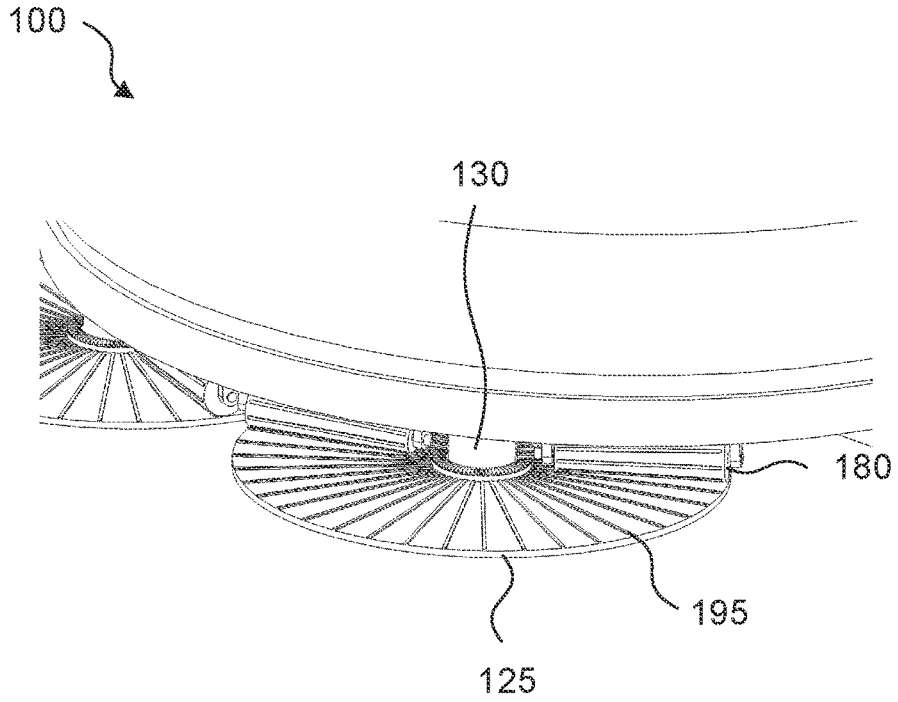

FIG. 11 shows yet a further embodiment of a cleaning robot 100. Purely by way of example, a constellation of the embodiment of FIG. 9 is assumed here which has a contact pressure element 180 in the shape of a truncated cone. The cleaning element 125 has a structuring 195 on an upper side that faces the contact pressure element 180. The contact pressure element 180 has a corresponding structuring 195, so that the contact pressure element 180 can engage in a positive-locking manner in the cleaning element 125. In other embodiments, only the cleaning element 125 or only the contact pressure element 180 can have a structured surface.

Figure 12:
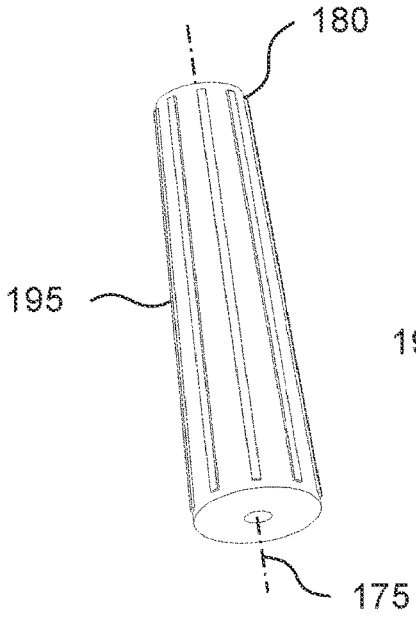
FIGS. 12 to 14 show embodiments of contact pressure elements.
Figure 13:
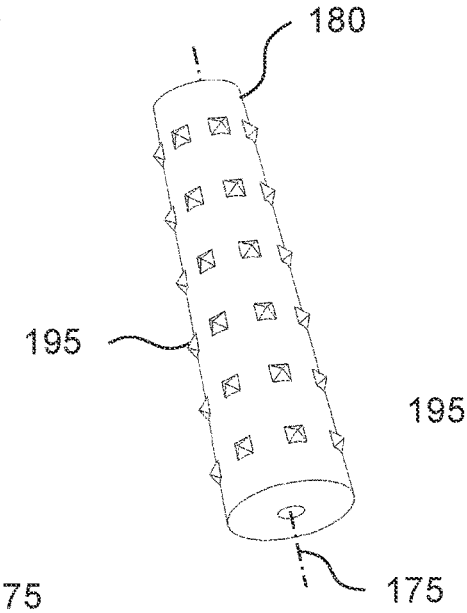
Figure 14:
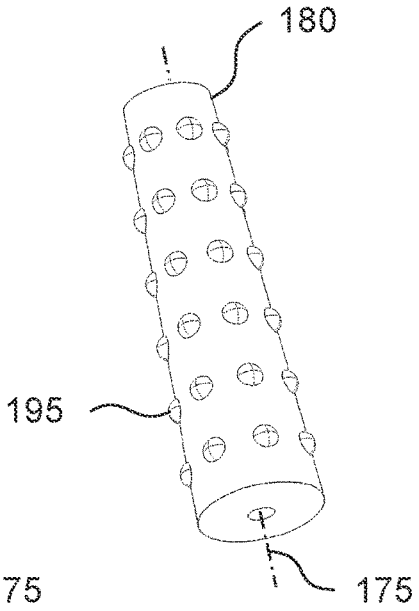

FIGS. 12 to 14 show different embodiments of a structuring 195 of a contact pressure element 180. FIG. 12 shows essentially axially extending webs corresponding to the embodiment shown in FIG. 11. The webs 195 are distributed at regular intervals around the horizontal axis of rotation 175 on the peripheral surface of the contact pressure element 180. Each web 195 can be raised or recessed.

FIG. 13 shows a structuring 195 in the form of pyramids regularly distributed on the peripheral surface and extending radially away from the horizontal axis of rotation 175. This structuring 195 can also alternatively be designed as a recess.

FIG. 14 shows a further variant of the structuring 195 in the form of flat spherical knobs which are regularly distributed on the peripheral surface. A negative embodiment is also possible.

If the cleaning element 125 is to engage in a positive-locking manner in the contact pressure element 180, the structuring 195 of the cleaning element 125 can be designed to correspond to the structuring 195 of the contact pressure element 180. If one element 125, 180 has a raised section, the other has a recessed section. In addition to the structuring 195 shown, any other structuring is also possible.

It should be noted that the features described herein with respect to a particular embodiment can also be used on another described embodiment. For example, structuring 195 is also possible on a cylindrical contact pressure element 180.

REFERENCE CHARACTERS

100 Cleaning robot
105 Floor surface
110 Housing
115 Sensor
120 Cleaning facility
125 Cleaning element
130 Drive
135 Processing width
140 First section, below the housing
145 Second section, protrudes beyond the housing
150 Contact pressure apparatus
155 Drive wheel
160 Support wheel
165 Obstacle
170 Vertical axis of rotation
175 Horizontal axis of rotation
180 Contact pressure element
185 First gear wheel
190 Second gear wheel
195 Structuring

The invention claimed is:

1. A cleaning robot comprising:

a housing;

a flat cleaning element being configured to be moved along a floor surface, and a section of the cleaning element protruding beyond a contour of the housing;

the cleaning element being flexible and configured to be deformed vertically in the event of a collision with an obstacle; and a contact pressure facility for pressing a section of the cleaning element that is located below the housing against the floor surface, and the contact pressure facility having at least one contact pressure element that is rotatable about a substantially horizontal axis of rotation.

2. The cleaning robot according to claim 1, further comprising a drive for moving the cleaning element relative to the housing.

3. The cleaning robot according to claim 2, wherein the drive acts on the cleaning element via a contact pressure element.

4. The cleaning robot according to claim 1, wherein the contact pressure facility comprises a contact pressure plate.

5. The cleaning robot according to claim 1, wherein the cleaning element is configured to be rotated about a vertical axis of rotation relative to the housing, and the horizontal axis of rotation is substantially perpendicular to the vertical axis of rotation.

6. The cleaning robot according to claim 1, wherein a plurality of horizontal axes of rotation are provided, each of plurality of horizontal axes of rotation having at least one associated contact pressure element.

7. The cleaning robot according to claim 6, wherein a plurality of contact pressure elements is rotatably mounted about a horizontal axis of rotation.

8. The cleaning robot according to claim 6, wherein at least one contact pressure element has the shape of a truncated cone.

9. The cleaning robot according to claim 1, wherein the contact pressure element is structured on a surface facing the cleaning element.

10. The cleaning robot according to claim 1, wherein the cleaning element is structured on a surface facing the contact pressure element.

* * * * *